United States Patent [19]

Sallade et al.

[11] 3,956,989

[45] May 18, 1976

[54] FRAGMENTATION DEVICE

[75] Inventors: Charles E. Sallade, Cinnaminson, N.J.; James D. Nicolo, Philadelphia, Pa.

[73] Assignee: The United States of America as represented by the Secretary of the Army, Washington, D.C.

[22] Filed: Dec. 8, 1966

[21] Appl. No.: 601,291

[52] U.S. Cl. ..... 102/67

[51] Int. Cl.[2] ..... F42B 13/18; F42B 13/48

[58] Field of Search ..... 102/56 X, 67 X; 148/143 X

[56] References Cited

UNITED STATES PATENTS

| | | | |
|---|---|---|---|
| 1,985,456 | 12/1934 | Nelson | 148/18 |
| 2,044,780 | 6/1936 | Hardigg | 102/67 X |
| 2,411,862 | 12/1946 | Arnold | 102/67 |
| 2,763,545 | 9/1956 | Breeler | 148/143 X |
| 2,789,928 | 4/1957 | Wallerius | 148/143 X |
| 2,805,466 | 9/1957 | Lyon | 102/56 X |
| 3,117,041 | 1/1964 | Koistinen | 148/143 X |
| 3,178,324 | 4/1965 | Grange et al. | 148/143 |
| 3,271,207 | 9/1966 | Davis | 148/143 |
| 3,288,657 | 11/1966 | Morita et al. | 148/143 |
| 3,378,367 | 4/1968 | Lars-Eije Friis et al. | 148/143 |

OTHER PUBLICATIONS

MacConochie, Steel Shell Manufacture, Ordnance, Vol. 39, No. 310, May–June 1955, pp. 995–1001.

1953 ASM Paper No. 27, Klinger, Barnett, Frohmberg, & Troiano, The Embrittlement of Alloy Steel at High Strength Levels.

*Primary Examiner*—Charles T. Jordan

*Attorney, Agent, or Firm*—Nathan Edelberg; Robert P. Gibson; Arthur M. Suga

[57] ABSTRACT

A high explosive device with improved fragmentation is provided with a wall of wrought steel having a ferrite-martensite microstructure. This is obtained by heating in a temperature range in the ferrite-austenite region of the iron-carbon phase diagram until equilibrium is established between the two phases, and then quenching to retain the ferrite and transform the austenitic phase to martensite for said microstructure.

1 Claim, 1 Drawing Figure

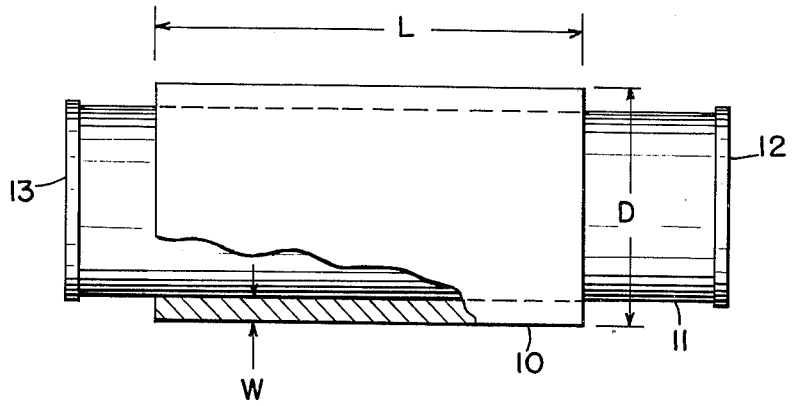
INVENTOR.
CHARLES E. SALLADE
JAMES D. NICOLO
BY Harry M. Saragovitz
Edward J. Kelly, Herbert Berl
& S. Dubroff
ATTORNEYS:

FRAGMENTATION DEVICE

This invention relates to fragmentation of high explosive devices and particularly, to a wrought steel high explosive device and a method for producing the same which exhibits improved fragmentation properties.

The problem of fragmentation effectiveness has always been contiguous with wrought steel ordnance articles such as shells, bombs, projectiles and the like. Many of the ordnance articles in use today are made of pearlitic malleable cast iron which has a fragmentation characteristic superior to conventionally heat treated wrought materials. While the use of malleable iron has increased the lethality of certain explosive devices, the continued use of this material is not without a present disadvantage.

Due to the increased demands for commercial products, the malleable iron industry is presently working to full capacity and cannot fulfill the increased requirements for ordnance items made of this material. Therefore, because of the limited availability of malleable iron, new ordnance items must be developed which are comparable, if not better, than the existing devices.

Accordingly, a principal object of the present invention is to provide a method for improving the fragmentation effectiveness of explosive devices which is unattended by the foregoing disadvantage of the prior art.

Another object of the invention is to provide a method for improving the fragmentation properties of wrought steel high explosive devices.

Still another object of the invention is to provide wrought steel high explosive devices exhibiting improved fragmentation lethality.

Other objects of the invention will in part be obvious and in part appear hereinafter in the following description of the invention and in the accompanying drawings.

The drawings accompanying and forming part of this specification depicts a plan view with a partial section of a test cylinder design and assembly for evaluation of the inventive device.

The present invention solves the problem of fragmentation effectiveness in high explosive devices by employing a specific microstructure in a hypoeutectoid steel. The design of most explosive devices are fixed except for compensating for the density differential that exists between the different materials employed. Therefore, the only recourse to improving the fragmentation effectiveness of an explosive device is through selection of materials and altering the physical properties of these materials without compromising on safety and reliability. The selection of available materials is based on various factors that are believed to have an effect on fragmentation. These factors include chemical composition, mechanical properties and versatility in obtaining specific microstructures.

Articles made in accordance with the disclosed invention exhibit fragmentation comparable to prior art articles made of pearlitic malleable cast iron and are attended by a better and wider range of mechanical properties. An additional advantage is that a hypoeutectoid steel which can be fabricated and heat treated on conventional production type equipment is used to achieve these results.

The microstructure of the disclosed invention consists of two distinct and coexistant metallurgical phases with divergent physical properties, ferrite and untempered martensite. By varying the proportion of ferrite to martensite both the mechanical properties and fragmentation characteristics can be varied. A continuous network of either phase is not required, thereby eliminating a two-step heat treating process.

Upon examination of fragmented test cylinders of conventionally heat treated hypoeutectoid steels with homogeneous microstructures, smooth, tapered fracture surfaces indicative of a shear type failure is observed. In the majority of fragments, directionality, inherently caused by the forming of the explosive device, is evident by the failure of the material parallel to the axis of the device resulting in long fragments of considerable mass and undesirable shape. Another characteristic of shear failure is that both inside and outside surfaces are evident on the fragment with no radial fracturing, again accounting for larger fragments. The result of using this type of steel is elongated fragments with an average mass too high for optimum lethality.

When a ferrite-martensite microstructure is stressed only the ferrite, which is ductile, deforms and the hard martensitic phase tends to prevent a shear type of fracture. A standard tensile test specimen of the material, when stressed beyond its elastic limit, will not yield locally, and elongation is uniform throughout its gage length. Because of this property, fragments of this material are more equiaxed and exhibit a crystalline, brittle type of fracture. Radial fracturing also occurs and the overall effect is to increase the number of fragments and lower the average fragment mass for higher lethality.

A ferrite-martensite microstructure is obtained by heating a hypoeutectoid steel in the temperature range bounded by the $A_1$ and $A_3$ lines of the Iron-Carbon phase diagram. Within this area ferrite and austenite exist in equilibrium. The higher the temperature, the greater the amount of austenite and the closer to the $A_1$ line, the greater amount of ferrite. Once equilibrium between the two phases has been established at any one temperature, the steel is oil quenched to room temperature to retain the ferrite and transform the austenitic phase to martensite.

The material is not tempered after oil quenching since the extremely hard martensite is essential for optimum fragmentation effectiveness. However, because of the hard, brittle nature of martensite, sufficient ferrite must be present to provide ductility and machineability. Thus for any particular application a balance must be maintained between the co-existing phases. The higher the proportion of martensite, the better the fragmentation and the higher the proportion of ferrite, the better the ductility and machineability.

In the course of the investigation leading to the present invention the following experimental procedure was conducted:

EXPERIMENTAL PROCEDURE

The invention may be more fully understood by recourse to the accompanying drawing. Test cylinder 10 with a 2.96 inch outside diameter D, a 0.2225 inch wall W and a length L of 5 inches were machined from solid bar stock for each material considered.

To obtain the desired microstructures for each material, heat treatment specimens were prepared by quartering half inch disks. These specimens were heat treated in molten salt pots with a temperature range of 1250° to 1650°F. Two adjacent salt pots were used when a particular heat treatment required quenching from a higher to a lower temperature.

After heat treatment, a metallographic sample was cut from each specimen, prepared, and examined under the microscope. After the desired microstructure was obtained in the heat treatment specimen, the fragmentation test cylinders were then subjected to the same heat treatment.

For each specific heat treatment, three cylinders were fragmented and two were subjected to mechanical testing and microstructural examination. The three test cylinders were loaded with an explosive by inserting an explosive container 11 within the cylinder, and an electric primer 12 was placed onto one end of the cylinder opposite an end cap 13. The whole assembly was then placed in a box to provide an air space around the cylinder. The box containing the test cylinder was then placed in sawdust and the explosive was initiated electrically. The fragments were collected magnetically and sorted according to size. These fragments were then weighed and examined microscopically.

EXPERIMENTAL RESULTS

Table I tabulates the fragmentation test data from test cylinders of AISI 4150 steel subjected to two different heat treatments. Cylinders in Group A were subjected to a heat treatment to produce a microstructure of ferrite and pearlite and mechanical properties representative of wrought steel projectiles in the lower strength ranges. Group B test cylinders, also of AISI 4150 steel, were heat treated to produce a ferrite-martensite microstructure with comparable yield strength levels. Also shown in Table I are results of another grade of steel, Group C - AISI 1340, with a ferrite-martensite microstructure and test results of a very high-strength steel with a homogeneous tempered martensitic microstructure, Group D - AISI 98V65.

Table II contains mechanical test data for each Group of cylinders tested.

DISCUSSION OF RESULTS

It is evident from Table I that a change in microstructure can produce an approximate 3-fold change in the number of fragments produced. Group C cylinders which have a yield strength comparable to Group A also point out the effect of a change in microstructure. There is some increase in fragmentation effectiveness by employing an extremely high yield strength but the results of Group D cylinders do not compare with the increase resulting from the ferrite-martensite microstructure.

In comparing the mechanical properties of the two heat treatments for 4150 steel, it is noted that the percent reduction in area and elongation is considerably lower in the Group B samples. Examination of the tensile specimens microstructures reveal considerable grain distortion in the Group A samples whereas in the Group B samples, no grain distortion was evident.

The lower amount of fragments recovered from Group D cylinders as compared to Groups B and C, is attributed to the greater amount of ferrite present in the microstructure. Fragmentation results of Group D indicate that a homogeneous microstructure, even at very high strength levels, will not produce the desired fragmentation.

The test results indicate that the fragmentation characteristics of a microstructure consisting of ferrite and martensite in the proper proportions is as good as those of pearlitic malleable iron.

A factor not indicated in the accompanying tables which might become important is the prior treatment of the wrought steel devices. The initial condition of wrought steel has a substantial bearing on the final properties of the completed ferrite-martensite microstructure and these treated steels are accordingly selected to be employed as a starting point depending on the particular final properties desired. For example, a normalized wrought steel, because it is allowed to cool in the air after heating, has a fine-grained microstructure. By using a normalized steel before heat treating

TABLE I

| SPECIMEN | STEEL | HEAT TREATMENT | CYLINDER | Number of Fragments Recovered From Test Cylinders No. 1 | No. 2 | No. 3 |
|---|---|---|---|---|---|---|
| Group A | 4150 | Heated to 1550°F and held for 1 hour. Quenched to 1240°F and held for 15 minutes. Quenched in oil. | | 1311 | 1536 | 1740 |
| Group B | 4150 | Heated to 1400°F and held for 10 minutes. Quenched in oil. | | 4776 | 5544 | 5388 |
| Group C | 1340 | Heated to 1550°F and held for one hour. Air cooled and reheated to 1350°F for 10 minutes. Quenched in oil. | | 5928 | 4583 | 4752 |
| Group D | 98V65 | Heated to 1550°F and held for one hour. Air cooled and reheated to 1400°F for 7 minutes. Quenched in oil. | | 3732 | 3420 | 3192 |

TABLE II

| Specimen | MECHANICAL PROPERTIES OF TEST CYLINDERS Yield Strength | Tensile Strength | % Elongation | % Reduction in Area |
|---|---|---|---|---|
| Group A | 64,400 PSI | 116,200 PSI | 23 | 56 |
| | 66,600 | 118,200 | 22 | 55 |
| Group B | 50,500 | 149,300 | 9 | 19 |
| | 51,700 | 152,200 | 8 | 19 |
| Group C | 66,800 | 171,900 | 8 | 19 |
| | 65,400 | 166,700 | 10 | 21 |
| Group D | 227,300 | 239,200 | 8 | 35 |
| | 222,200 | 237,600 | 7 | 31 |

according to the invention, the finer initial microstructure tends to result in greater ductility without an appreciable effect on fragmentation lethality. It would be preferable to begin with a normalized steel if extreme firing stresses are probable, as in the larger caliber projectiles. Other treatments, such as soft annealing, may be desirable where a coarse-grained microstructure is needed.

It will be further understood that various other changes may be made in the invention device and the use thereof without departing from the spirit and scope of this invention. For example, other combinations of microstructural phases such as pearlite-martensite, pearlite-bainite, and ferrite-bainite could also be used to effect fragmentation characteristics.

We claim:

1. A high explosive device of the projectile type having a wall of wrought steel of hypoeutectoid composition consisting exclusively of a discontinuous, balanced ferrite-untempered martensite microstructure for improved fragmentation effects.

* * * * *